US008943992B1

(12) United States Patent
Petersen et al.

(10) Patent No.: US 8,943,992 B1
(45) Date of Patent: Feb. 3, 2015

(54) REMOTE AUTONOMOUS REPLENISHMENT BUOY FOR SEA SURFACE CRAFT

(71) Applicants: Scott M Petersen, Virginia Beach, VA (US); Donald B Harris, Arlington, VA (US); Robert Galway, Virginia Beach, VA (US)

(72) Inventors: Scott M Petersen, Virginia Beach, VA (US); Donald B Harris, Arlington, VA (US); Robert Galway, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 42 days.

(21) Appl. No.: 13/929,527

(22) Filed: Jun. 27, 2013

(51) Int. Cl.
*B65D 88/78* (2006.01)
*B63B 22/02* (2006.01)

(52) U.S. Cl.
CPC ..... *B63B 22/023* (2013.01)
USPC ..... 114/256

(58) Field of Classification Search
USPC ..... 114/256, 264
See application file for complete search history.

(56) References Cited

U.S. PATENT DOCUMENTS

| | | | | |
|---|---|---|---|---|
| 2,963,179 | A | 12/1960 | Kanady et al. | |
| 3,735,722 | A | 5/1973 | Hooper et al. | |
| 3,943,875 | A | 3/1976 | Sanders | |
| 4,067,080 | A * | 1/1978 | Sylverst | 114/256 |
| 4,286,537 | A | 9/1981 | Hvide | |
| 4,356,784 | A | 11/1982 | Waters et al. | |
| 4,506,623 | A * | 3/1985 | Roper et al. | 114/256 |
| 6,101,964 | A * | 8/2000 | Lesesne | 114/256 |
| 6,336,419 | B1 | 1/2002 | Breivik | |
| 6,883,453 | B1 | 4/2005 | Mulhern | |
| 6,945,187 | B1 * | 9/2005 | Woodall et al. | 114/256 |
| 7,025,014 | B1 | 4/2006 | Forgach et al. | |
| 7,156,036 | B2 | 1/2007 | Seiple | |
| 7,506,606 | B2 | 3/2009 | Murphy | |
| 7,699,015 | B1 | 4/2010 | Said | |
| 8,020,505 | B1 | 9/2011 | Galway | |
| 8,225,735 | B1 | 7/2012 | Galway | |
| 8,356,567 | B1 | 1/2013 | Gaston et al. | |

* cited by examiner

*Primary Examiner* — Lars A Olson
(74) *Attorney, Agent, or Firm* — Dave A. Ghatt

(57) ABSTRACT

An apparatus for servicing one or more water vessels, in particular, the invention is directed towards an autonomous replenishment buoy for fueling one or more water vessels. The autonomous replenishment buoy has a first configuration when not servicing water vessels, and a second configuration when performing fueling or other servicing functions. The autonomous replenishment buoy may float at the surface of the water, or may be moored beneath the surface of the water in the first configuration when not servicing water vessels. The autonomous replenishment buoy may transform from the first configuration to the second configuration to perform fueling and other services on water vessels.

11 Claims, 7 Drawing Sheets

REMOTE AUTONOMOUS REPLENISHMENT BUOY FOR SEA SURFACE CRAFT

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application is related to concurrently filed U.S. Provisional patent application, 61/840,349, hereby incorporated by reference, entitled, "Hummingbird Fueling Station for Sea Surface Water Vessels," by inventor Scott Peterson.

TECHNICAL FIELD

The following description relates generally to an apparatus for servicing one or more water vessels, in particular, the invention is directed towards an autonomous replenishment buoy for fueling one or more water vessels, capable of mooring beneath the surface of the water, and capable for transforming from a first configuration to a second configuration.

BACKGROUND

This invention is directed towards a class of surface water vessels, capable of missions with an extended range or prolonged operational period that might benefit from an intermediate refueling capability or local refueling capability in lieu of returning to the host ship for fuel, and including aluminum hulled vessels of about 40 feet, displacing over 20,000 pounds. These vessels may be unmanned surface vessels (USVs) powered by internal combustion engines driving one or more propellers or waterjets. Fuel capacity generally ranges between 400 to 800 gallons which translates to a limited endurance while performing the mission for which they were designed and a limited range. All must be brought to the mission area by a larger host vessel.

Generally, each USV must be retrieved from the sea and brought on board the host vessel to be refueled. This reduces the percentage of time the USVs are conducting their mission, reducing their effectiveness and also causes the host vessel to remain relatively close to the mission area. Exposing a manned ship to a mission area is undesirable. Operational risk can be reduced by reducing the time a manned ship must stay in mission areas or by increasing the host ship's distance from these areas. While recovering, the host vessel may be restricted in course and speed, unable to launch and recover other USVs, and not able to operate other systems, which limits its efficiency. If the host vessel can only launch/recover one USV at a time (as is typically the case), this creates a queuing problem for groups of USVs and subtracts from the total mission time available as all must wait while each unit is replenished and re-launched before returning to the mission area. Deteriorating sea conditions may make recovery difficult, dangerous, or impossible and disrupt the USVs mission. It is therefore desired to have an autonomous replenishment station other than a parent ship, in the vicinity of the USVs, to perform services such as fueling, so that it is not necessary to travel back to the parent ship.

SUMMARY

In one aspect, the invention is an autonomous replenishment buoy for servicing one or more water vessels wherein each of the one or more water vessels has a probe extending from the bow of the respective water vessel. In this aspect, the autonomous replenishment buoy has a main cylindrical body and a fuel receptacle within the main cylindrical body. The autonomous replenishment buoy also has one or more probe receiving members, each of the one or more probe receiving members for receiving a water vessel probe therein. The autonomous replenishment buoy also has one or more servicing arms. Each servicing arm has an energy absorbing and guiding portion for guiding and absorbing the energy of an incoming water vessel. According to the invention, the autonomous replenishment buoy has a first configuration in a non-deployed state and a second configuration in a deployed state, wherein the in the first configuration the autonomous buoy comprises the substantially cylindrical body with the energy absorbing guide arrangement contained within the substantially cylindrical body, and in the second configuration the energy absorbing guide arrangement and the probe receiving member extend from the substantially cylindrical body.

BRIEF DESCRIPTION OF THE DRAWINGS

Other features will be apparent from the description, the drawings, and the claims.

DETAILED DESCRIPTION

Figure 1A:
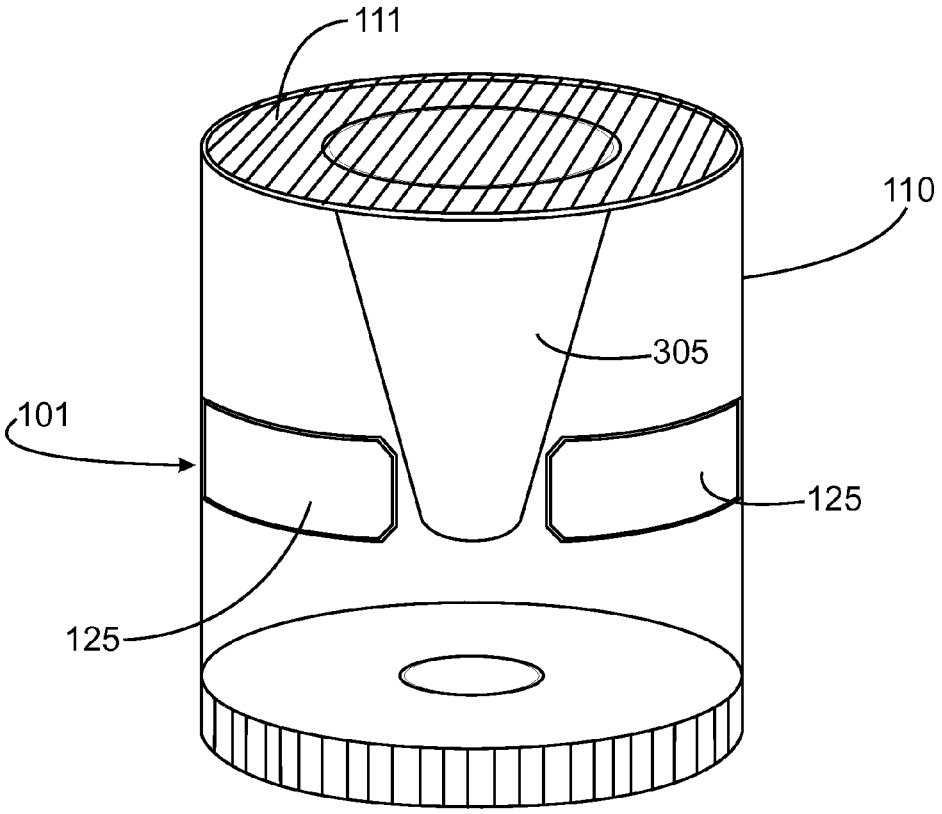
FIG. 1A is an exemplary illustration of a first configuration of an autonomous replenishment buoy, according to an embodiment of the invention.

The invention is directed towards an autonomous replenishment buoy having a first and second configuration. As outlined below, the buoy has a first configuration when it is stored or when it is positioned in open water. In the first configuration, the buoy may be held beneath the surface of the water where it is not visible. The autonomous replenishment buoy may be in the second configuration when deployed, performing servicing functions. FIG. 1A is an exemplary illustration of a first configuration 100 of an autonomous replenishment buoy 101, according to an embodiment of the invention. As outlined below, the autonomous replenishment buoy 101 may be used in at-sea or open water applications to provide fuel and/or other maintenance services to water vessels, such as recharging energy supplies etc.

Figure 1B:
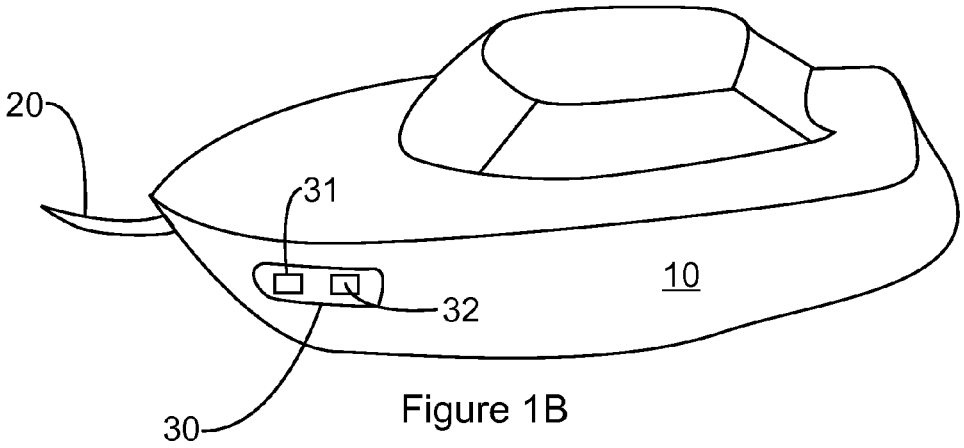
FIG. 1B is an exemplary illustration of a water vessel to be serviced at the autonomous replenishment buoy, according to an embodiment of the invention.

FIG. 1B is an exemplary illustration of one of the one or more water vessels 10 to be serviced at the autonomous replenishment buoy 101, according to an embodiment of the invention. Each water vessel 10 may be a manned or an unmanned surface vessel, each having a forwardly projecting elongated probe 20 at the bow of the water vessel 10. The probe 20 may be pivotally connected at the bow, and may be a mechanism for physically connecting the water vessel 10 to the autonomous replenishment buoy 101. According to an embodiment of the invention, the probe 20 may also be used as a conduit receiving fuel therethrough. In another embodiment of the invention, the probe 20 may be used to convey energy for recharging the water vessel's energy supplies, such as batteries etc. The water vessel may also include a communications device 30 for communicating with the autonomous replenishment buoy 101. The communications device 30 may include a signal transmitter 31 that transmits acoustic signals or a secure data transfer transceiver 32 that communicates with a corresponding transceiver on the autonomous replenishment buoy 101. According to an embodiment of the invention, the secure data transfer transceiver 32 may be located on the probe 20, so that once securely docked at the autonomous replenishment buoy 101, data may be securely transferred. It should be noted that although only one water vessel 10 is illustrated, water vessels to be serviced at the autonomous replenishment buoy 101 may have different shapes and dimensions.

Returning to FIG. 1A, the replenishment buoy 101 has a first configuration 100 that is substantially cylindrical in shape. As outlined below, the autonomous replenishment buoy 101 has a main body 110 having servicing elements therein, including a fuel receptacle 305. The fuel receptacle 305 may be a bladder having any other desired shape, and may be affixed to the top wall 111 of the main body 110 by means of webbing straps. According to an embodiment of the invention, the fuel receptacle 305 is a bladder having a truncated cone shape that is vertically oriented that collapses upwards into itself as fuel is drained. The main body 110 may be a rigid integral housing having a plurality of hatches 125 which provide opening through which servicing elements may extend, when the buoy 101 is deployed. According to an embodiment of the invention, the bottom of the main body 110 may be opened or may have an opening to allow mooring elements to extend below the buoy 101. According to an embodiment of the invention, the combination of this opened bottom and the fuel receptacle 305 being a bladder may be used to add buoyancy to the autonomous replenishment buoy 101. According to this embodiment, the bladder 305 bears on the underside of the top 111 of the main body 110. The fuel in the bladder 305 will contribute to the total buoyancy of the buoy 101 because the fuel is lighter than the sea water. As fuel is removed the bladder will collapse upwards and sea water will displace the transferred volume. The density difference will provide enough pressure to lift the fuel to and prime an associated transfer pump.

The servicing elements may be constructed from a combination of metals, reinforced plastics, and compliant materials such as urethane forms that may be spring biased. The servicing elements may also be or have inflatable elements. The substantially cylindrical first configuration 100 may be maintained by folding and/or releasably locking the compliant materials about each other in a manner that allows for easy release when deployed. The collapsible features reduce the overall volume, allowing the replenishment buoy 101 to be folded and stored in the first configuration 100. This allows the replenishment buoy 101 to be fitted into an International Standards Organization compatible shipping enclosure, simplifying shore storage and transportation. This also allows for deployment into the water from different types of transportation. For example the replenishment buoy 101 may be deployed from the deck of a large parent ship by lifting overboard with a crane, rolling overboard, or launching from a stem ramp or the like. The replenishment buoy 101 may also be deployed from a helicopter, airplane, or subsurface water vessel. It should be noted that although FIG. 1A shows configuration 100 as cylindrical, the configuration may have alternative shapes, such as spherical or cubical.

Figure 2:
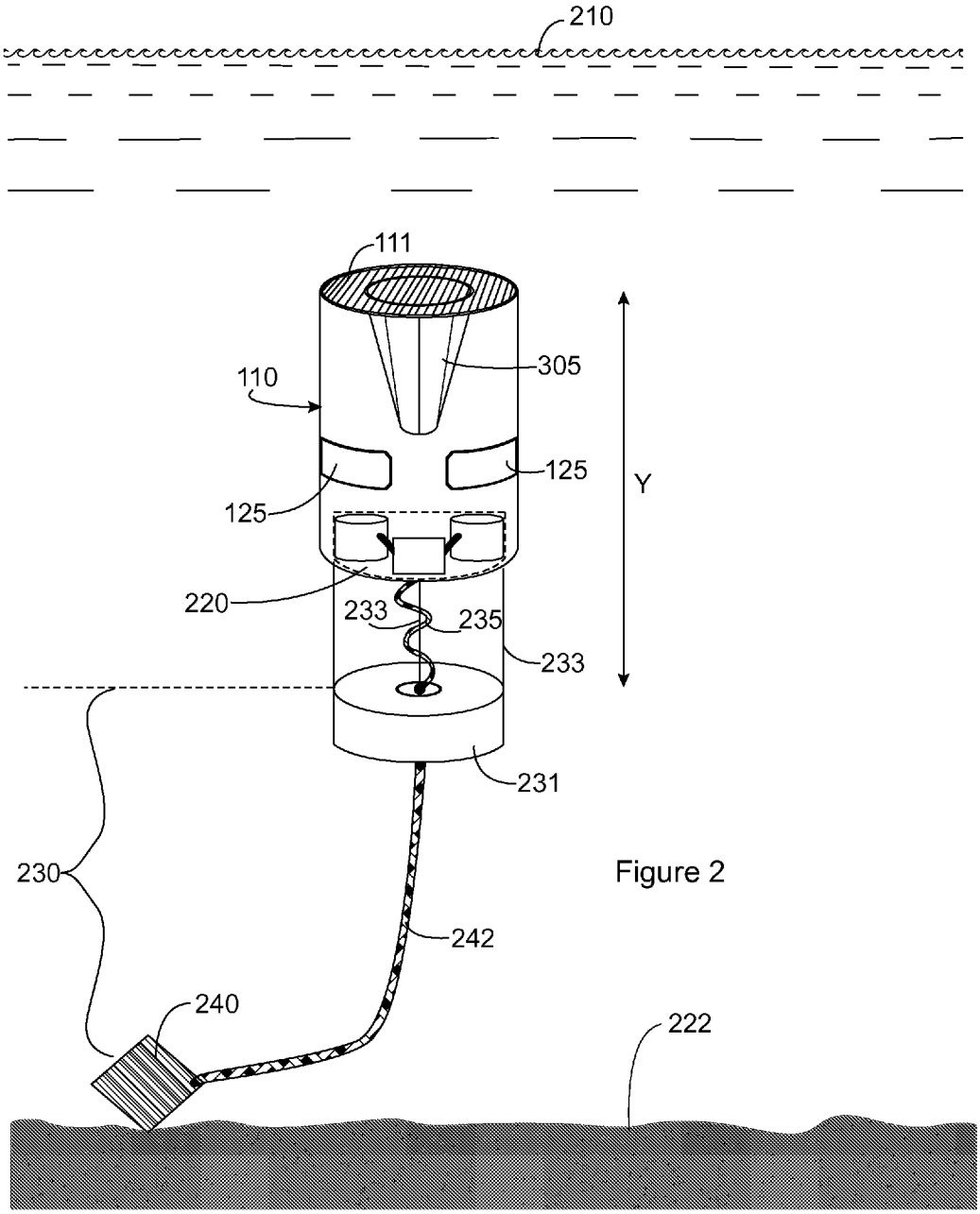
FIG. 2 is an exemplary illustration of a mooring arrangement for autonomous replenishment buoy, according to an embodiment of the invention.

FIG. 2 is an exemplary illustration of a mooring arrangement for autonomous replenishment buoy 101, according to an embodiment of the invention. As shown in FIG. 2, the autonomous replenishment buoy 101 is in the first substantially cylindrical configuration 100, and is in open water. FIG. 2 shows the autonomous replenishment buoy 101 suspended above the floor of the ocean 222, well below the water's surface level 210. FIG. 2 merely shows the ocean floor 222 and the surface level 210, but does not represent the distance below the surface 201 of about the surface 222 at which the buoy 101 is suspended. As outlined below, according to an embodiment of the invention, the buoy is suspended at about 30-50 feet of the sea floor 222. The mooring arrangement in combination with a ballast assembly, shown schematically at 220, facilitates this capability. The ballast assembly 220 includes known ballast elements such as one or more pumps, one or more ballast tanks, and an air supply or the like. The air supply could be an automotive style Supplemental Restraint System (SRS) like an air bag, a chemical gas generator, or stored gas under pressure in a metal or composite flask with the associated plumbing. It should be noted that subsurface ballast assemblies and the operation thereof is well known, and need not be addressed in detail herein. The mooring arrangement 230 includes down weight 231 which is movable in the Y-directions shown in FIG. 2. The down weight 231 is initially positioned (see dotted line illustration) at a lower portion of a main cylindrical body portion 110 of the buoy 101. Cables 233 facilitate the downward or upward Y-direction (vertical) movement of the down weight 231. The cables 233 may be attached to a powered winch (not shown) The mooring arrangement 230 also includes an anchor 240 and a chain 242 forming a ground tackle for securing the autonomous replenishment buoy 101 to the ocean floor 222. As shown, the chain 242 is attached to the down weight 231. The mooring arrangement may also include an umbilical cord 235, which may be used as an addition means to secure the down weight 231. As outlined below, the ballast assembly 220 and the mooring arrangement combine to move the autonomous replenishment buoy 101 in the Y-directions.

As stated above, the autonomous replenishment buoy 101 in its first configuration 100, may be deployed to a desired area by offloading from an aircraft, ship, or subsurface water vessel, where it is allowed to float on the surface. Thus, the replenishment buoy 101 may remain in the first configuration 100 at the surface 210 until servicing operations are required, at which time it converts to a second configuration. Alternatively the replenishment buoy 100 may dive beneath the surface of the water, until needed. The subsurface condition is by lowering the down weight 231 by winding down the cables 233 and attached anchor 240, and then by flooding the ballast tank in the ballast tank assembly 220. According to an embodiment of the invention, the anchor 240, lowered is lowered till it reaches the sea floor 222, which moors the buoy 101. The down weight 231 reduces the ground tackle scope requirements. The down weight 231 is smooth and free of features that may entangle the sea floor 222. According to an embodiment of the invention, the ground weight 231 may also be lowered to the sea floor.

As shown in FIG. 2, the autonomous replenishment buoy 101 hangs suspended in the water above the down weight 231. As outlined below, signals from the communications device 30 of the water vessel 10 will cause the buoy to release air into the air chamber in the ballast assembly 220 and resurface. The water vessel 10 may be a USV, and the communications device 30 may emit acoustic signals, which are received by a transponder 510 on the autonomous replenishment buoy 101. As stated above, a gas source to refloat the buoy 101 could be an automotive style Supplemental Restraint System (SRS) like an air bag, a gas generator, chemical or otherwise, or stored gas under pressure in a metal or composite flask with the associated plumbing. According to a preferred embodiment, the air supply is a compressed air source and associated compressor. The autonomous replenishment buoy 101 may be required to submerge and resurface a plurality of times. Depending on the number of submerge/surface cycles, a means to re-pressurize the flask may be required. If only one submerge/surface evolution is required, the system could release air from a buoyancy tank and submerge as described above and then simply utilize a pay-out line to re-surface.

FIGS. 3A-3F are exemplary illustrations of a second configuration of an autonomous replenishment buoy 101, according to an embodiment of the invention. As stated above, the autonomous replenishment buoy 101 may be in the second configuration when performing servicing functions such as fueling. In operation, during fueling operations, the autonomous replenishment buoy 101 transforms from the first configuration 100, shown in FIG. 1A into a second configuration (201, 202, and 203) shown in FIGS. 3A-3F. This transformation is conducted after the buoy 101 surfaces, under the operations of the ballast assembly 220 as outlined above.

Figure 3A:
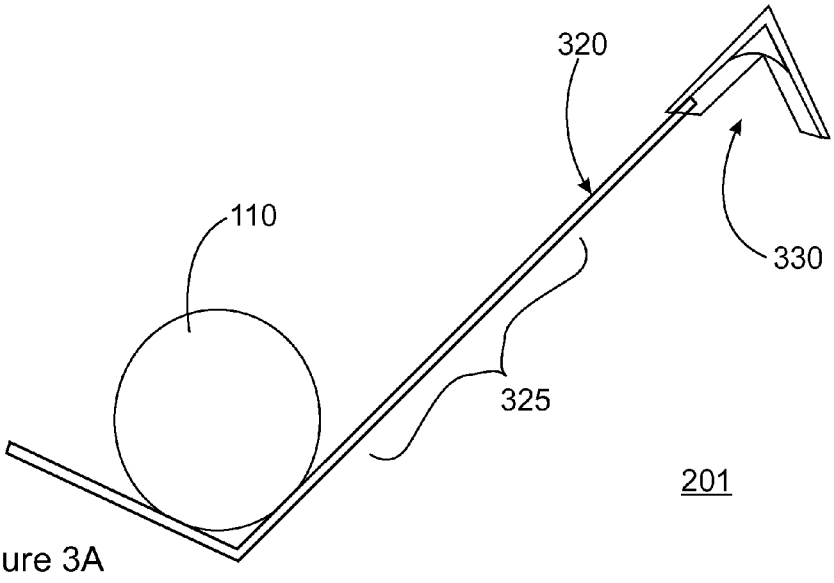
FIG. 3A is an exemplary top down view of a second configuration of an autonomous replenishment buoy, according to an embodiment of the invention.
Figure 3B:
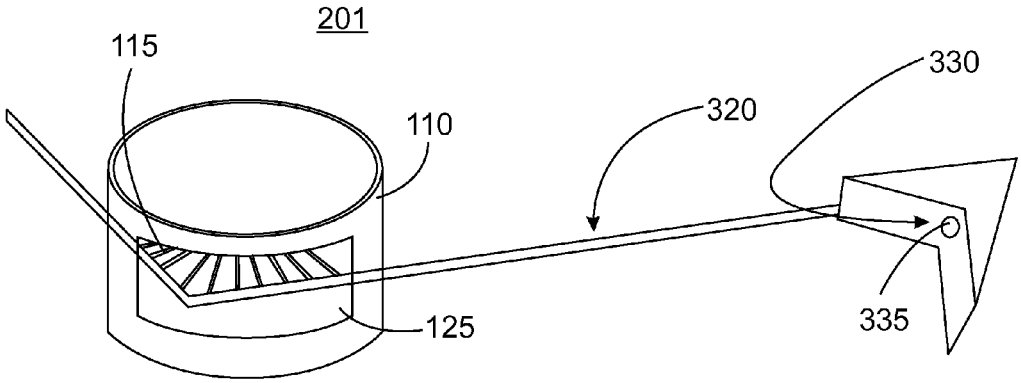
FIG. 3B is an exemplary perspective illustration of a second configuration of an autonomous replenishment buoy, according to an embodiment of the invention.

FIGS. 3A and 3B are exemplary illustrations of a second configuration 201 autonomous replenishment buoy 101, according to an embodiment of the invention. FIG. 3A is a top down view, and shows the autonomous replenishment buoy 101 having the main cylindrical body 110, and a fuel receptacle 305 within the main cylindrical body 110. FIGS. 3A and 3B also show a probe receiving member 335 for receiving a water vessel probe 20 therein. This secures the water vessel 10 to the buoy 101 for servicing. When secured to the buoy 101, fuel may be supplied to the water vessel 10 through the probe 20, as outline in U.S. Pat. No. 8,225,735, which is herein incorporated by reference in its entirety.

FIG. 3A also shows in the second configuration 201, the autonomous replenishment buoy 101 includes a servicing arm 320 having an energy-absorbing and guiding portion 325 for guiding and absorbing the energy of an incoming water vessel 10. As shown in FIG. 3B, the servicing arm 320 extends out of the main cylindrical body 110 through one or more hatches 125. FIG. 3A also shows holding elements 125, which may include elastic elements for securing the servicing arm 320 to the main body 110 as the arm 320 extends outwards. The autonomous replenishment buoy 101 may also include one or more counter-balancing weights within the main body 110 to properly balance the buoy 101.

Figure 4A:
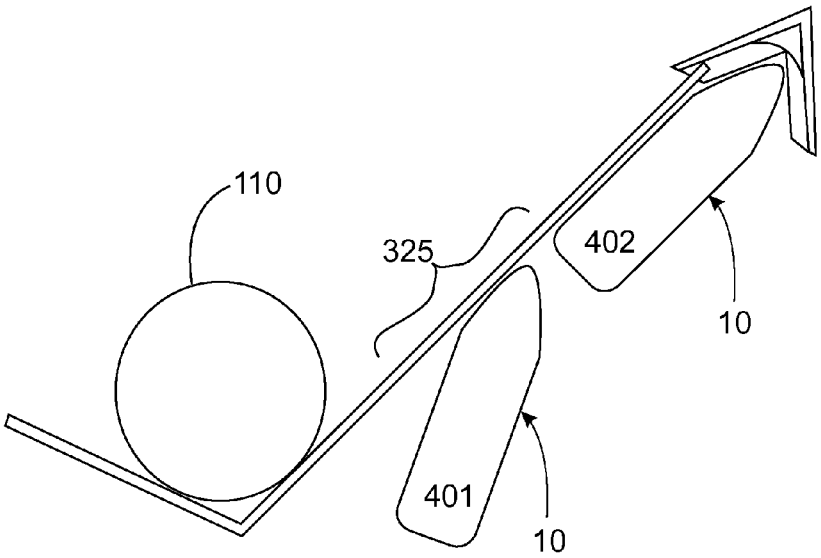
FIG. 4A is an exemplary illustration of an autonomous replenishment buoy and the operation of receiving a water vessel, according to an embodiment of the invention.

FIG. 3A shows the buoy 101 in the second configuration 201, having a bow cradle portion 330 for cradling the bow of a water vessel 10, i.e., the substantially V-shaped aperture at the end of the arm 320. As illustrated, the probe receiving member 335 is positioned within the bow cradle portion 330. FIG. 4A is an exemplary illustration of the vessel receiving operation of the autonomous replenishment buoy 101. FIG. 4A shows the second configuration 201, and as outlined above this includes the servicing arm 320, which includes the energy absorbing, and guiding portion 325 and the bow cradle portion 330, which is a substantially V-shaped aperture that receives the bow of a water vessel 10. FIG. 4A shows the water vessel 10 in a first position 401 and a second subsequent position 402. The positions 401 and 402 are merely exemplary illustrations of 2 of the many possible positions taken by the water vessel 10, while docking at the autonomous replenishment buoy 101.

As outlined above, the water vessel 10 may be a USV. As the water vessel 10 approaches the buoy 101, it contacts the servicing arm 320 at the receiving portion 325. The contact is made in a side-on manner as opposed to a head-on manner. The collision energy is dissipated as the water vessel 10 slides along the receiving portion 325, shown at position 401. The water vessel 10 may approach at about 4-6 knots. Because of the side-on contact and the energy dissipation, the water vessel 10 is smoothly guided into the bow cradle portion 330, i.e., the substantially V-shaped aperture shown at position 402 where the probe 20 at the bow of the vessel 10 is guided into the probe receiving portion 335. The width or angle of the "V" at the cradle portion 330 is specifically dimensioned to allow the probe 20 of the water vessel 10 to make a connection at the probe receiving portion 335. It should be noted that as water vessel 10 contacts and is guided by the energy absorbing and guiding portion 325, the buoy 101 is also moved about by this interaction with the water vessel 10. The motion of the buoy 101 includes translation and rotation through the water, which dissipates the kinetic energy and momentum of the water vessel 10. Remaining momentum drives the water vessel 10 into the receiving portion 335.

Figure 3C:
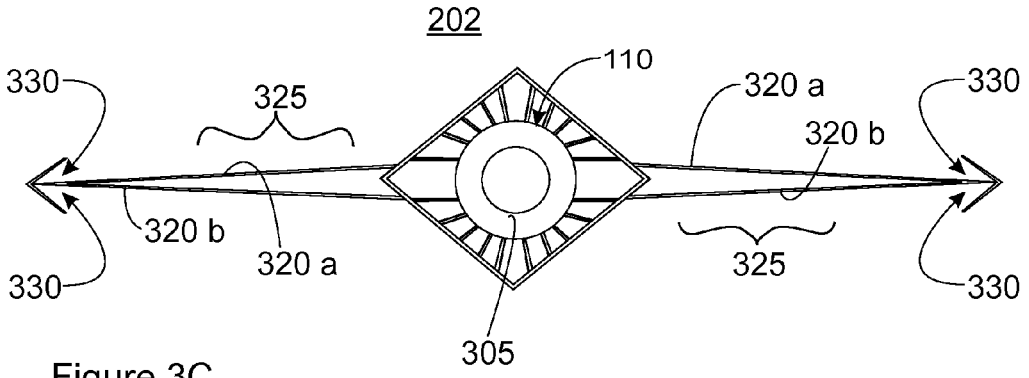
FIG. 3C is an exemplary top down view of a second configuration of an autonomous replenishment buoy, according to an embodiment of the invention.
Figure 3D:
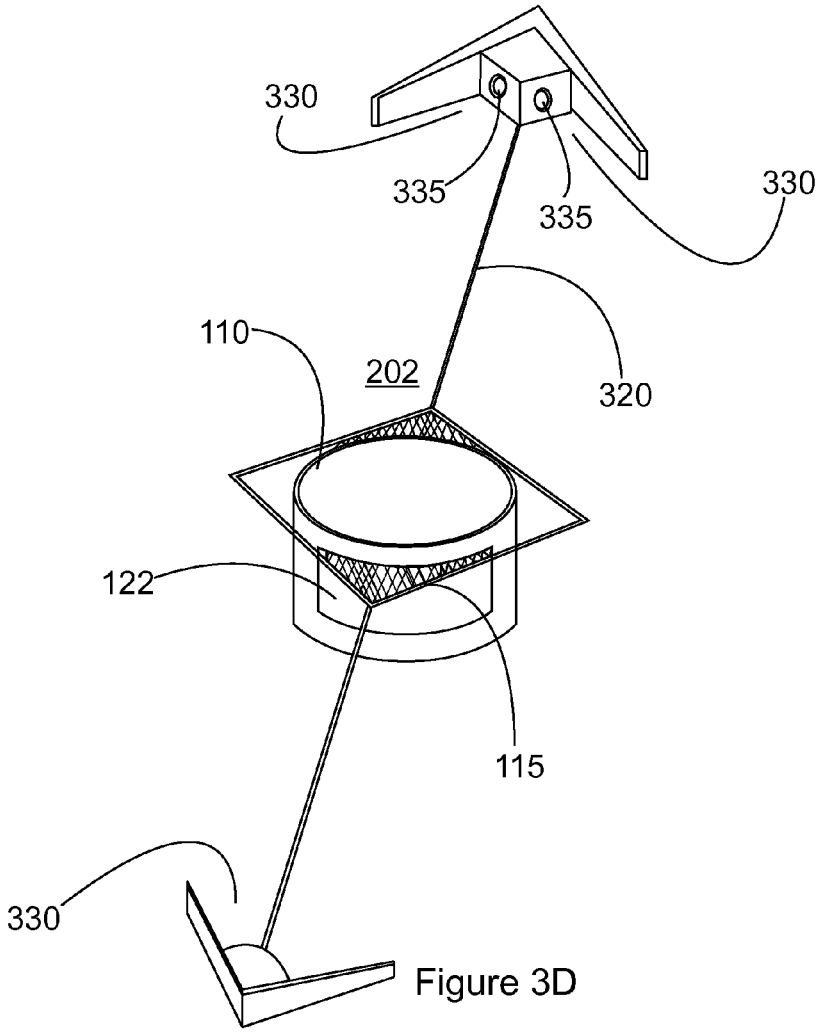
FIG. 3D is an exemplary perspective illustration of a second configuration of an autonomous replenishment buoy, according to an embodiment of the invention.

FIGS. 3C and 3D are exemplary illustrations of a second configuration 202 autonomous replenishment buoy 101, according to an embodiment of the invention. FIGS. 3C and 3D show the autonomous replenishment buoy 101 having the main cylindrical body 110, and a fuel receptacle 305 within the main cylindrical body 110. The Figures also show the buoy 101 having a plurality of probe receiving members 335 for receiving one or more water vessel probes 20 in a respective probe receiver 335. As stated above, the probe 20 is used to secure the water vessel 10 to the buoy 101 for servicing.

FIGS. 3C and 3D also show in the second configuration 202, the autonomous replenishment buoy 101 includes two servicing arms 320, each arm 320 capable of receiving a water vessel 20 on either side $\mathbf{320}_a$ and $\mathbf{320}_b$ having energy absorbing and guiding portions 325 for guiding and absorbing the energy of an incoming water vessel 10. As shown in FIG. 3D, the servicing arms 320 extend out of the main cylindrical body 110 through one or more hatches 125. FIG. 3A also shows holding elements 125, which may be elastic elements for securing the servicing arms 320 to the main body 110 as the arms 320 extend outwards. The autonomous replenishment buoy 101 may also include one or more counter-balancing weights within the main body 110 to properly balance the buoy 101.

Figure 4B:
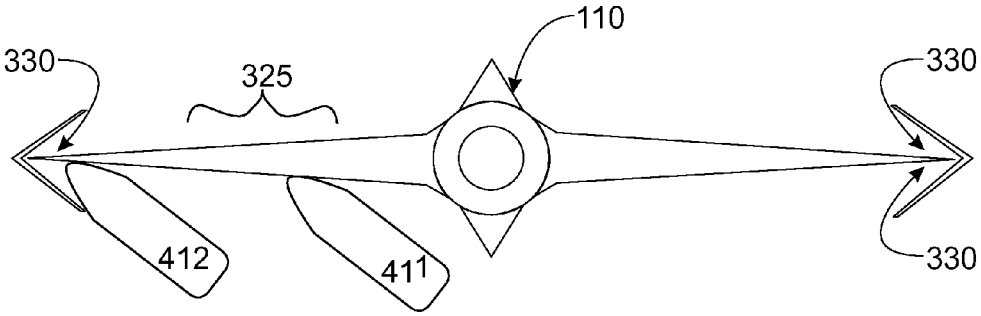
FIG. 4B is an exemplary illustration of an autonomous replenishment buoy and the operation of receiving a water vessel, according to an embodiment of the invention.

The figures show the buoy 101 in the second configuration 202, having four bow cradle portions 330 at the end of each arm 320, for cradling the bow of a water vessel 10. As illustrated, the probe receiving members 335 are each positioned within the bow cradle portion 330. FIG. 4B is an exemplary illustration of the vessel receiving operation of the autonomous replenishment buoy 101. FIG. 4B shows the second configuration 202, and as outlined above this includes the servicing arms 320, which include the energy absorbing, and guiding portions 325 and the bow cradle portions 330. FIG. 4B shows a water vessel 10 in a first position 411 and a second subsequent position 412. The positions 411 and 412 are merely exemplary illustrations of 2 of the many possible positions taken by the water vessel 10, while docking at the autonomous replenishment buoy 101. As the water vessel 10, which may be a USV, approaches the buoy 101 it contacts the servicing arm 320 at one of the receiving portions 325. As outlined above, each servicing arm 320 is capable of receiving a water vessel 20 on either side $\mathbf{320}_a$ and $\mathbf{320}_b$, with each arm having two bow cradle portions 335, i.e., the substantially V-shaped aperture at the end of the servicing arms 320. Thus, in the second configuration 202, there are 4 different bow cradles for receiving water vessels 10. In operation, a water vessel 10 approaches and contacts the buoy 101 in a side-on manner, and the collision energy is dissipated as the water vessel 10 slides along the receiving portion 325. The water vessel 10 may approach at about 4-6 knots. Because of the side-on contact and the energy dissipation, the water vessel 10 is smoothly guided into the respective bow cradle portion 330. The width or angle of the "V" at the cradle portion 330 is specifically dimensioned to allow the probe 20 of the water vessel 10 to make a connection at the probe receiving portion 335. Similar to the embodiment outlined above with respect to FIG. 4A, as water vessel 10 contacts and is guided by the energy absorbing and guiding portion 325, the buoy 101 is also moved about by this interaction with the water vessel 10. The motion of the buoy 101 includes translation and rotation through the water, which dissipates the kinetic energy and momentum of the water vessel 10. Remaining momentum drives the water vessel 10 into the receiving portion 335.

Figure 3E:
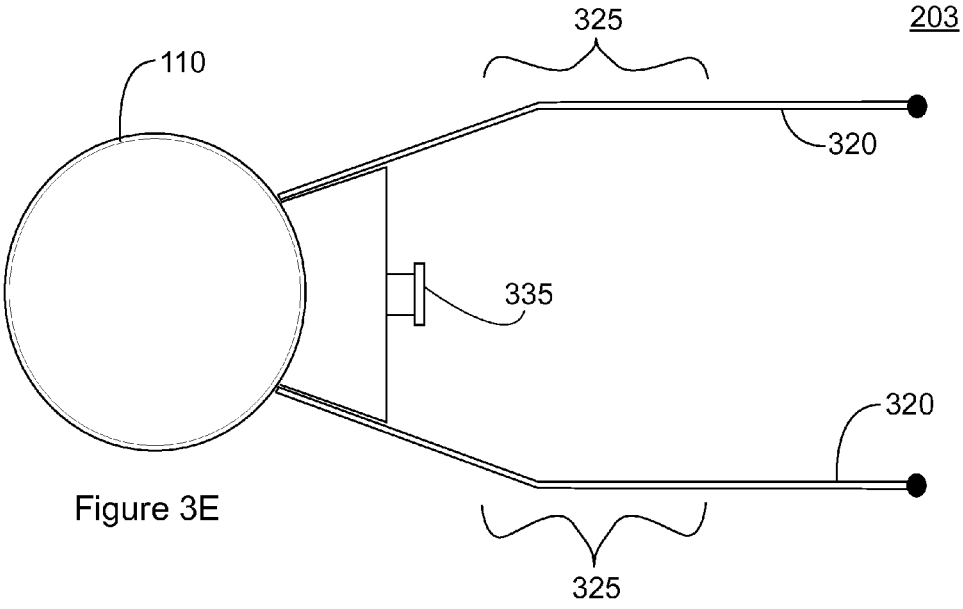
FIG. 3E is an exemplary top down view of a second configuration of an autonomous replenishment buoy, according to an embodiment of the invention.
Figure 3F:
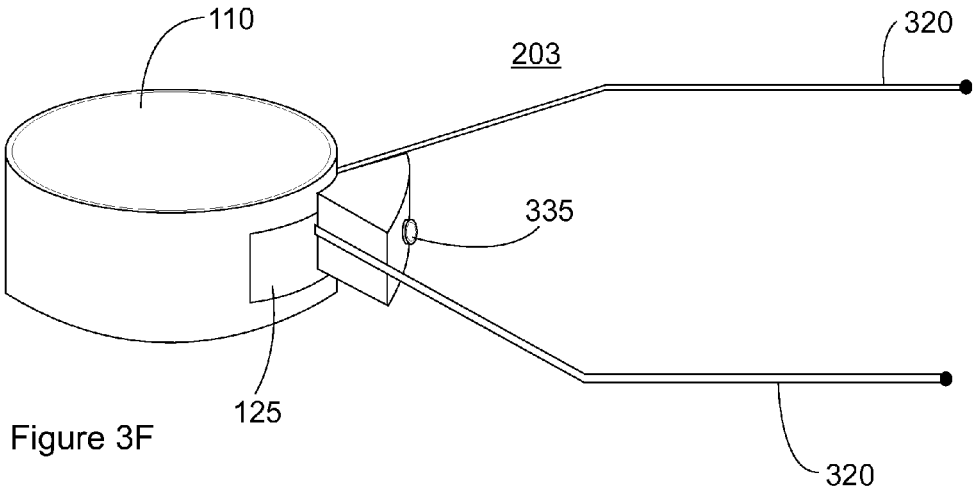
FIG. 3F is an exemplary perspective illustration of a second configuration of an autonomous replenishment buoy, according to an embodiment of the invention.

FIGS. 3E and 3F are exemplary illustrations of a second configuration 203 autonomous replenishment buoy 101, according to an embodiment of the invention. FIGS. 3E and 3F show the autonomous replenishment buoy 101 having the main cylindrical body 110, and a fuel receptacle 305 within the main cylindrical body 110. The figures also show a probe receiving member 335 for receiving a water vessel probe 20 therein. This secures the water vessel 10 to the buoy 101 for servicing.

Figure 4C:
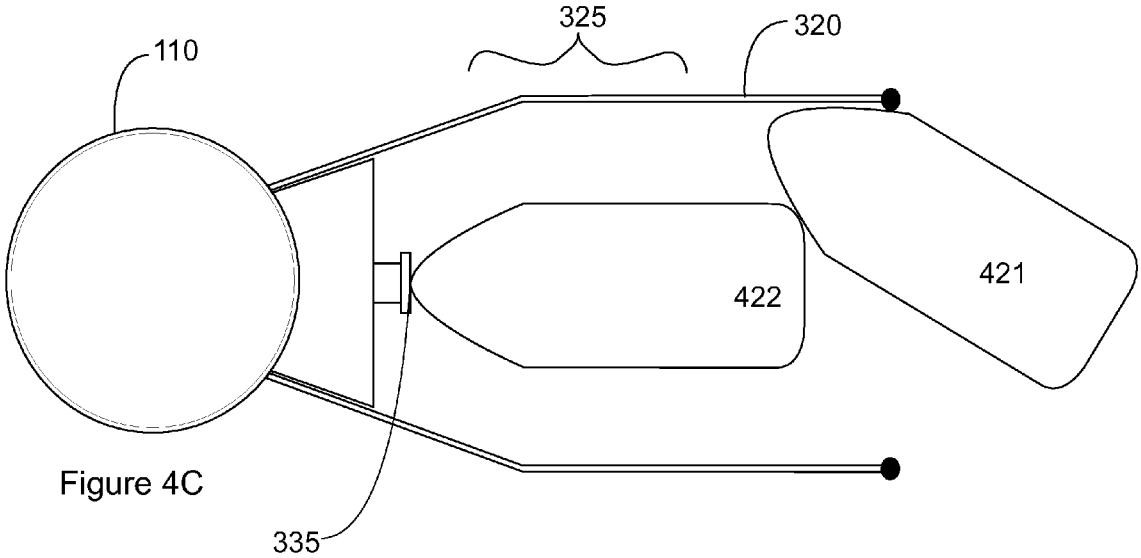
FIG. 4C is an exemplary illustration of an autonomous replenishment buoy and the operation of receiving a water vessel, according to an embodiment of the invention.

FIGS. 3E and 3F also show in the second configuration 203, the autonomous replenishment buoy 101 includes servicing arms 320 having energy absorbing and guiding portions 325 for guiding and absorbing the energy of an incoming water vessel 10. Although not illustrated, the servicing arms 320 may also be held by holding elements such as elastic elements, as outlined with respect to FIGS. 3B and 3D. In this embodiment of FIGS. 3E and 3F, the arms 320 act to funnel a water vessel 10 towards the main cylindrical body 110, and in particular towards the probe receiving member 335, which is located on main cylindrical body 110. FIG. 4C is an exemplary illustration of the vessel receiving operation of the autonomous replenishment buoy 101. FIG. 4C shows the second configuration 203, and as outlined above this includes the servicing arms 320, which includes the energy absorbing and guiding portion 325. FIG. 4C shows a water vessel 10 in a first position 421 and a second subsequent position 422. The positions 421 and 422 are merely exemplary illustrations of 2 of the many possible positions taken by the water vessel 10, while docking at the autonomous replenishment buoy 101. As the water vessel 10 approaches the buoy 101, it contacts the servicing arms 320 at the respective receiving portions 325. The arms 320 guide and funnel the water vessel 10 into probe receiver 335.

As outlined above, elements such as the servicing arms 320 may be constructed from a combination of metals, reinforced plastics, and compliant materials such as urethane foam coupled with inflatable elements. Metal structure and weldments attaching the components such as the probe receivers 335 provide a rigid mounting framework for machinery, enclosures for water sensitive elements such as electronics and batteries, and hard lifting and transportation interfaces. Extremely lightweight composite materials resistant to corrosion may also be used for minimal radar cross section. Galvanic protection may also be applied for buoys 101 that are meant to be deployed for extended periods.

Figure 5:
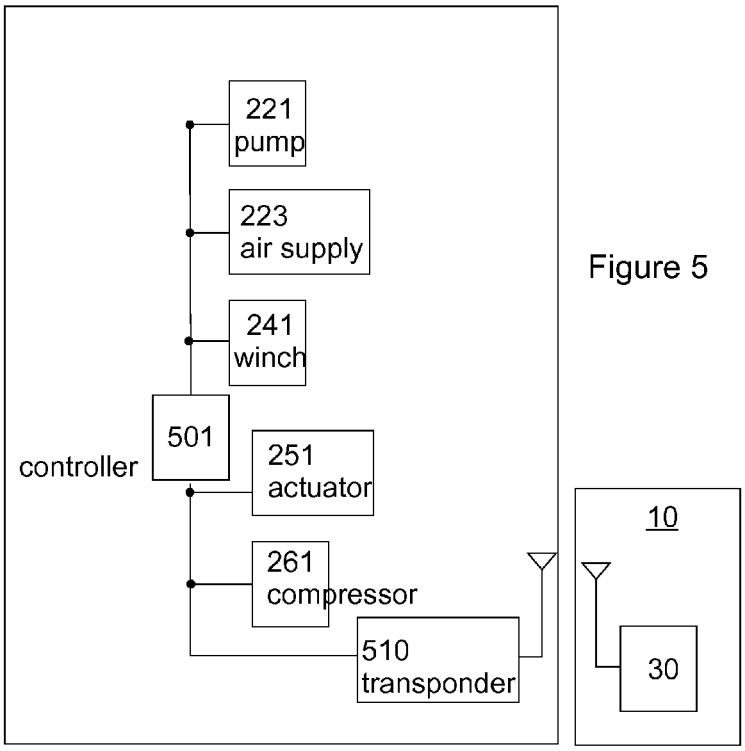
FIG. 5 is a schematic illustration of a controller arrangement for the autonomous replenishment buoy, according to an embodiment of the invention.

FIG. 5 shows a fueling station controller 501, which may be a programmable microprocessor, which controls the operations of the autonomous replenishment buoy 101, such as controlling the mooring or the upward and downward motions of buoy 101. The controller also controls the process of transforming from the first configuration 100 to a second configuration (201, 202, 203). The controller 501 also controls fueling operations including communications between the buoy 101 and the one or more water vessels 10 to be serviced by the autonomous replenishment buoy 101.

The controller 501 is electronically connected to different elements of the ballast assembly 220. FIG. 501 shows the controller 501 electronically connected to the ballast pumps 221 for pumping water into the ballast tank, and the ballast air supply 223, which may be a compressed air source and associated compressor, for supplying air to the ballast tank. The controller 501 is also connected to the powered winch 241 for controlling the downward or upward Y-direction (vertical) movement of the down weight 231 in the mooring arrangement. By controlling the ballast assembly 220 (see FIG. 2) and the mooring arrangement 230 (see FIG. 2), the controller 501 controls how the buoy 101 dives below the surface of the water and how the buoy 101 rises to the surface level of the water. As described with respect to FIG. 2, these vertical controls are typically performed when the autonomous replenishment buoy 101 is in the first configuration 100.

As stated above, the controller 501 also controls the transformation from the first configuration 100 to a second configuration (201, 202, 203). As shown schematically in FIG. 5, the controller 501 is connected to an actuator 251 for one or more latching devices that secure elements such as one or more servicing arms 320, and a compressor 261 for inflating the inflatable elements. By controlling the actuator 251 and the compressor 261, the controller 501 controls the transformation of the buoy 101 from the first configuration 100 to a second configuration (201, 202, 203). So for example, regarding the illustrations of FIGS. 3A and 3B, when the controller actuates the actuator 252 and compressor 261, the buoy 101 transforms from configuration 100 to configuration 201 with the single servicing arm 320.

The controller 501 also receives communications from and sends communications to the water vessel 10. The controller 501 may also receive and communicate with remotely located operators. The communications helps to govern the fueling and/or other servicing activities. As shown in FIG. 5, the controller 501 is electronically attached to transponder 510 that receives signals from signal transmitter 31. As outlined above, the signal transmitter 31 may emit an acoustic signal which is received by the transponder 510 in the buoy 101. The signal sent by the transmitter 31 of the water vessel 10 may initiate a fueling process, and according to an embodiment of the invention, is sent when the water vessel 110 is within a few hundred feet of the autonomous replenishment buoy 101. The autonomous replenishment buoy 101 may receive the signal when it floats at the surface, or when it is moored or suspended beneath the surface of the water as shown in FIG. 2. If the buoy 101 is floating at the surface, in response to the signal, the controller 501 initiates the conversion from the first configuration 100 to the second configuration (201, 202, 203) as outlined above. If the buoy 101 is below the surface when it receives the signal, the controller 501 replenishes the ballast tank by supplying air from the air supply 223, which allows the buoy 101 to rise to the surface of the water. Then the controller 501 initiates the transformation process from the first configuration 100 to a second configuration (201, 202, 203), by initiating the actuator 251 and the compressor 261. Alternatively, the controller may be programmed so that it performs the surfacing and transformation from the first configuration 100 to a second configuration (201, 202, 203) after a predetermined time has elapsed, without receiving a signal from the water vessel 10. Thus, according to this embodiment, based on a programmed sequence of responses, the controller 501 supplies air to the ballast tank, via the air supply 223, which allows the buoy 101 to rise to the surface of the water. This process may be supplemented by the removal of water from the ballast tank by initiating the pump 221. Then the controller 501 initiates the transformation process from the first configuration 100 to a second configuration (201, 202, 203).

After the autonomous replenishment buoy 101 transforms from a first configuration 100 to one of the second configurations (201, 202, 203) the water vessel 10 may approach the buoy 101 as shown in FIGS. 4A, 4B, and 4C. Then, as illustrated, the water vessel 10, which may be a USV, contacts the one or more servicing arms 320, each having an energy absorbing and guiding portion 325. The one or more servicing arms 320 direct the water vessel 10 towards the probe receiver 335, so that the probe 20 is properly inserted into the probe receiver 335, thereby enabling the fuel and other services to be performed on the water vessel 10. During fueling the water vessel 10 may transmit data to the autonomous replenishment buoy 101. The data may be transmitted via the signal transmitter 31, or may be transmitted directly by means of data link 32 that communicates with a similar link 532 on the buoy. The data links (32, 532) may be wired links or may alternatively be wireless. The data transmitted from the water vessel 10 may include data such as mission data, which the buoy 101 stores in a memory in the controller 501.

What has been described and illustrated herein are preferred embodiments of the invention along with some variations. The terms, descriptions and figures used herein are set forth by way of illustration only and are not meant as limitations. For example, in addition to fueling, the autonomous replenishment buoy 101 may perform other servicing functions, such as recharging batteries or other energy supplies, etc. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. An autonomous replenishment buoy for servicing one or more water vessels wherein each of the one or more water vessels has a probe extending from the bow of the respective water vessel, the autonomous replenishment buoy comprising:
- a main cylindrical body;
- a fuel receptacle within the main cylindrical body;
- one or more probe receiving members, each of the one or more probe receiving members for receiving a water vessel probe therein;
- one or more servicing arms, each servicing arm comprising:
  - an energy absorbing and guiding portion for guiding and absorbing the energy of an incoming water vessel;
- wherein the autonomous replenishment buoy has a first configuration in a non-deployed state and a second configuration in a deployed state, wherein the in the first configuration the autonomous buoy comprises the substantially cylindrical body with said energy absorbing guide arrangement contained within said substantially cylindrical body, and in the second configuration said energy absorbing guide arrangement and said probe receiving member extend from the substantially cylindrical body.

2. The autonomous replenishment buoy of claim 1, further comprising a ballast assembly for facilitating the upward and downward movement of the autonomous replenishment buoy including the resurfacing of the autonomous replenishment buoy.

3. The autonomous replenishment buoy of claim 2, further comprising a mooring arrangement comprising:
- a vertically movable weight;
- a plurality of cables for lifting and lowering the vertically movable weight; and
- an anchor attached to the vertically movable weight, for maintaining the autonomous replenishment buoy below the surface of the water.

4. The autonomous replenishment buoy of claim 3, further comprising a transceiver and a memory for receiving and storing data from the one or more water vessels, when said one or more water vessels are docked at said replenishment buoy.

5. The autonomous replenishment buoy of claim 4, wherein the one or more servicing arms further comprise a bow cradle portion for cradling the bow of a water vessel, and wherein one of the one or more probe receiving members is positioned with the bow cradle portion.

6. The autonomous replenishment buoy of claim 5, wherein each of the one or more servicing arms comprises an inflatable material, and wherein in the second configuration each of the one or more servicing arms is inflated and extends from the main cylindrical body.

7. The autonomous replenishment buoy of claim 6 wherein the ballast assembly comprises a ballast pump for pumping water and an air supply for supplying air to a ballast tank, and wherein the mooring arrangement comprises a powered winch for controlling the lifting and lowering of the vertically movable weight, the autonomous replenishment buoy further comprising a controller electronically connected to each of the ballast pump, the ballast air supply, and the powered winch, wherein controller controls the upward and downward movements and the mooring of the autonomous replenishment buoy.

8. The autonomous replenishment buoy of claim 7 further comprising an actuator for one or more latching devices that secure the one or more servicing arms, and an air compressor for inflating the inflatable elements of the servicing arms, wherein the controller is electronically connected to the actuator and the compressor and wherein by actuating the actuator and the pump, the controller controls the transformation from the first configuration to the second configuration.

9. The autonomous replenishment buoy of claim 8 further comprising a transceiver for receiving signals from signal transmitters on the one or more water vessels, wherein the controller is electronically connected to the transceiver, and wherein in response to receiving a signal from the signal transmitter, the controller initiates the air storage tank release valve for supplying air to a ballast air chamber to move the autonomous replenishment buoy to the surface of the water, the controller further actuating the actuator and the pump to transform the autonomous replenishment buoy from the first configuration to the second configuration.

10. The autonomous replenishment buoy of claim 9, wherein the energy absorbing guide arrangement comprises two arms, each of the two arms comprising energy absorbing and guiding portions and two probe receiving members.

11. The autonomous replenishment buoy of claim 9, wherein the main cylindrical body comprises an open-bottom canister, and fuel receptacle comprises a bladder, the combination of the open-bottomed main cylindrical body and the bladder providing buoyancy to the autonomous replenishment buoy.

* * * * *